US011849278B2

(12) United States Patent
Wei

(10) Patent No.: US 11,849,278 B2
(45) Date of Patent: Dec. 19, 2023

(54) SPEAKER

(71) Applicant: MERRY ELECTRONICS (SUZHOU) CO., LTD., Suzhou (CN)

(72) Inventor: PengJiang Wei, Suzhou (CN)

(73) Assignee: MERRY ELECTRONICS (SUZHOU) CO., LTD., Suzhou (CN)

( * ) Notice: Subject to any disclaimer, the term of this patent is extended or adjusted under 35 U.S.C. 154(b) by 0 days.

(21) Appl. No.: 17/895,293

(22) Filed: Aug. 25, 2022

(65) Prior Publication Data

US 2023/0077560 A1 Mar. 16, 2023

(30) Foreign Application Priority Data

Sep. 16, 2021 (CN) ..... 202111085449.9

(51) Int. Cl.
*H04R 1/28* (2006.01)
*H04R 1/02* (2006.01)

(52) U.S. Cl.
CPC ..... *H04R 1/2849* (2013.01); *H04R 1/021* (2013.01); *H04R 1/288* (2013.01)

(58) Field of Classification Search
CPC .... H04R 1/021; H04R 1/2849; H04R 1/2857; H04R 1/288; H04R 7/04
See application file for complete search history.

(56) References Cited

U.S. PATENT DOCUMENTS 10,735,851 B2 8/2020 Mathur
2018/0359558 A1* 12/2018 Mathur ..... H04R 1/2857

FOREIGN PATENT DOCUMENTS

CN 109218860 A 1/2019
CN 111918188 A 11/2020
CN 113132851 A 7/2021
EP 3 678 383 A1 7/2020
TW M624428 U 3/2022

OTHER PUBLICATIONS

Ding et al., "Research advances in acoustic metamaterials and metasurface", Acta Physica Sinica, vol. 67, No. 19, 2018, pp. 194301 1-14.
Song et al., "Research Progress and Development Trends of Acoustic Metamaterials", Molecules, vol. 26, 2021, pp. 1-15.

* cited by examiner

*Primary Examiner* — Kile O Blair
(74) *Attorney, Agent, or Firm* — Birch, Stewart, Kolasch & Birch, LLP

(57) ABSTRACT

The present disclosure provides a speaker which includes a case component, a vibration plate, a driving component, a first adjustment unit, and a second adjustment unit. The case component has an accommodating space and a sound outlet channel. The accommodating space communicates with the sound outlet channel. The vibration plate is disposed in the accommodating space. The driving component is disposed in the accommodating space and configured to drive the vibration plate to vibrate. The first adjustment unit is disposed in the sound outlet channel, and the first adjustment unit is constituted of acoustic metamaterials. The second adjustment unit is disposed on one side of the vibration plate, and the second adjustment unit is constituted of acoustic metamaterials.

13 Claims, 9 Drawing Sheets

SPEAKER

CROSS REFERENCE TO RELATED DISCLOSURE

This application claims the priority benefit of China Patent Application Number CN202111085449.9, filed on Sep. 16, 2021, the full disclosure of which is incorporated herein by reference.

BACKGROUND

Technical Field

The present disclosure is related to a speaker, and in particular, a speaker having acoustic metamaterials.

Related Art

Speakers are devices that convert electronic signals into sound. Specifically, a speaker consists of a case, a magnet, a coil, and a diaphragm. When current is passed through the coil, the coil generates a magnetic field. The magnetic field generated by the coil interacts with the magnetic field of the magnet to make the coil be closer to or away from the magnet. Finally, the coil vibrates the diaphragm to produce sounds during the process that the coil is closer to or away from the magnet. The produced sound may be provided to a user for listening through the resonance of the casing.

For a micro-speaker with a side sound outlet design, the resonance area (also be referred to "front cavity") formed by the diaphragm and the case generates a sharp acoustic peak and valley, and the high-frequency sensitivity sharp declines. As a result, the user feels extremely uncomfortable after listening to the deviated audio, thereby greatly reducing the user experience.

In order to solve the problems mentioned above, the acoustic curve is generally improved by disposing an additional acoustic cavity or another diaphragm in the speaker. However, the additional acoustic cavity affects other components in the speaker, resulting in a drop of low frequency sensitivity. On the other hand, the structure of the two diaphragms has extremely high requirements on the fineness of the product, and a slight tolerance will lead to a large deviation of the acoustic curve. Therefore, how to improve the user experience without decreasing the sound quality of the speaker and increasing the difficulty of production has become an urgent issue to be solved in the art.

SUMMARY

The embodiments of the present disclosure disclose a speaker, in order to solve the problem that sharp acoustic peaks and valleys appear in the frequency response curve of the current speaker at a specific frequency.

In order to solve the above technical problems, the present disclosure is implemented as follows.

A speaker is provided, which includes a case component, a vibration plate, a driving component, a first adjustment unit, and a second adjustment unit. The case component has an accommodating space and a sound outlet channel. The accommodating space communicates with the sound outlet channel. The vibration plate is disposed in the accommodating space. The driving component is disposed in the accommodating space and configured to drive the vibration plate to vibrate. The first adjustment unit is disposed in the sound outlet channel, and the first adjustment unit is constituted of acoustic metamaterials. The second adjustment unit is disposed on one side of the vibration plate, and the second adjustment unit is constituted of acoustic metamaterials.

In some embodiments, the first adjustment unit is configured to adjust a frequency response curve of the speaker in a frequency range of 6-10 kHz, and the second adjustment unit is configured to adjust the frequency response curve of the speaker in a frequency range of 2-5 kHz.

In some embodiments, the accommodating space is divided into a first accommodating space and a second accommodating space by the vibrating plate. The second adjustment unit is in the first accommodating space. The driving component is in the second accommodating space. The sound outlet channel has a sound outlet, and one end of the sound outlet channel away from the sound outlet communicates with the first accommodating space.

In some embodiments, the first adjustment unit includes a first body and a second body. The first body has a first side plate and a plurality of first spacer plates, and the plurality of first spacer plates are disposed on the first side plate at intervals. The second body is oppositely disposed on one side of the first body, wherein the second body has a second side plate and a plurality of second spacer plates. The second side plate is disposed on one side of the plurality of first spacer plates away from the first side plate. The plurality of second spacer plates are disposed on the second side plate at intervals. The plurality of second spacer plates and the plurality of first spacer plates are alternately disposed and parallel to each other.

In some embodiments, the first adjustment unit includes a first adjustment inlet and a first adjustment outlet. The first adjustment inlet and the first adjustment outlet respectively are between two adjacent ones of the plurality of first spacer plates and the plurality of second spacer plates. The first adjustment inlet is closer to the first accommodating space, and the first adjustment outlet is closer to the sound outlet.

In some embodiments, each of the plurality of first spacer plates is between two adjacent ones of the plurality of second spacer plates.

In some embodiments, the accommodating space is divided into a first accommodating space and a second accommodating space by the vibration plate. The driving component is in the second accommodating space. The case component further has a side space, and the side space communicates with the first accommodating space. The first accommodating space is between the side space and the sound outlet channel, and the second adjustment unit is in the side space.

In some embodiments, the second adjustment unit includes a third body and a fourth body. The third body has a third side plate and a plurality of third spacer plates, and the plurality of third spacer plates are disposed on the third side plate at intervals. The fourth body is oppositely disposed on one side of the fourth body, wherein the fourth body has a fourth side plate and a plurality of fourth spacer plates. The fourth side plate is disposed on one side of the plurality of third spacer plates away from the third side plate. The plurality of fourth spacer plates are disposed on the fourth side plate at intervals. The plurality of third spacer plates and the plurality of fourth spacer plates are alternately disposed and parallel to each other.

In some embodiments, the second adjustment unit includes a second adjustment outlet and a third adjustment outlet. The second adjustment outlet and the third adjustment outlet respectively are between two adjacent ones of the fourth spacer plate and the third spacer plate, and the second adjustment outlet and the third adjustment outlet both face the first accommodating space.

In some embodiments, each of the plurality of third spacer plates is between two adjacent ones of the plurality of fourth spacer plates.

The speaker of the present disclosure improves the frequency response curve by the first adjustment unit disposed on the sound outlet channel and the second adjustment unit disposed on one side of the vibration plate. More specifically, the first adjustment unit and the second adjustment unit are respectively constituted of acoustic metamaterials, so the frequency response curve may be effectively improved without taking up too much space. In addition, the speaker's sound quality is not affected and the difficulty of speaker production does not increase by the acoustic metamaterials. As a result, the present disclosure achieves a speaker with an excellent frequency response curve.

BRIEF DESCRIPTION OF THE DRAWINGS

The figures described herein are used to provide a further understanding of the present disclosure and constitute a part of the present disclosure. The exemplary embodiments and descriptions of the present disclosure are used to illustrate the present disclosure and do not limit the present disclosure, in which.

DETAILED DESCRIPTION OF THE EMBODIMENTS

In order to make the objectives, technical solutions, and advantages of the present disclosure clearer, the technical solutions of the present disclosure will be described clearly and completely in conjunction with specific embodiments and the figures of the present disclosure. Obviously, the described embodiments are only a part of the embodiments of the present disclosure, rather than all the embodiments. Based on the embodiments in the present disclosure, all other embodiments obtained by a person of ordinary skill in the art without creative work fall within the protection scope of this disclosure.

The following description is of the best-contemplated mode of carrying out the present disclosure. This description is made for the purpose of illustrating the general principles of the present disclosure and should not be taken in a limiting sense. The scope of the present disclosure is best determined by reference to the appended claims.

Figure 1:
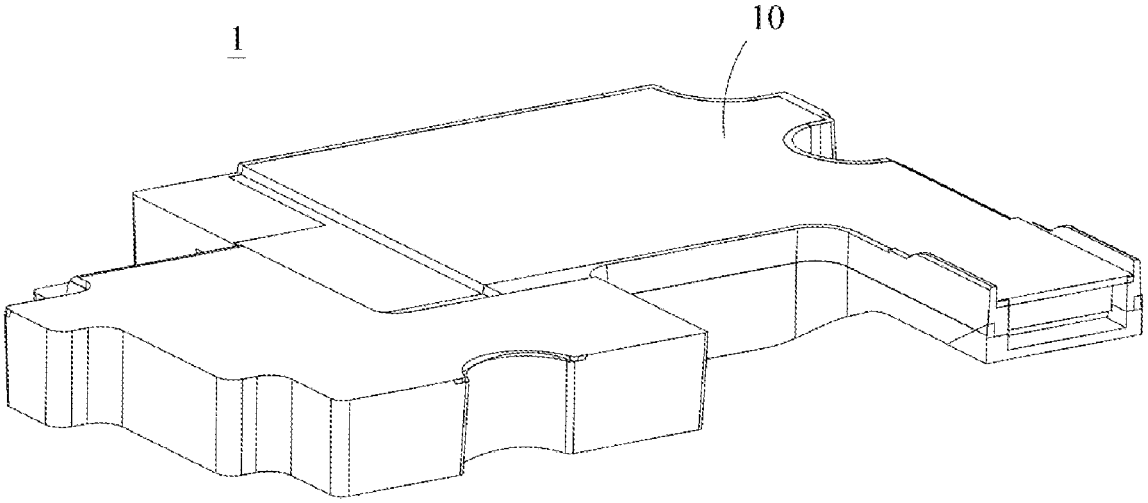
FIG. 1 is a schematic diagram of a speaker according to an embodiment of the present disclosure.
Figure 2:
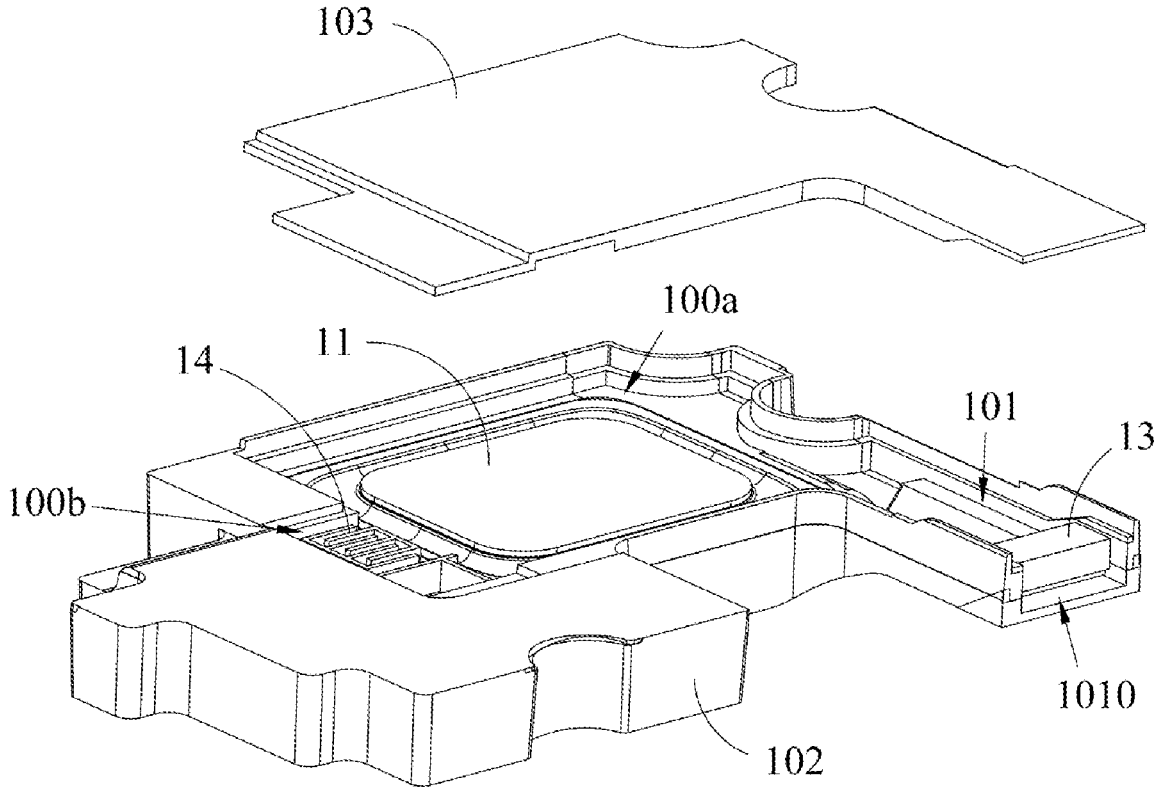
FIG. 2 is an exploded view of a speaker according to an embodiment of the present disclosure.
Figure 3:
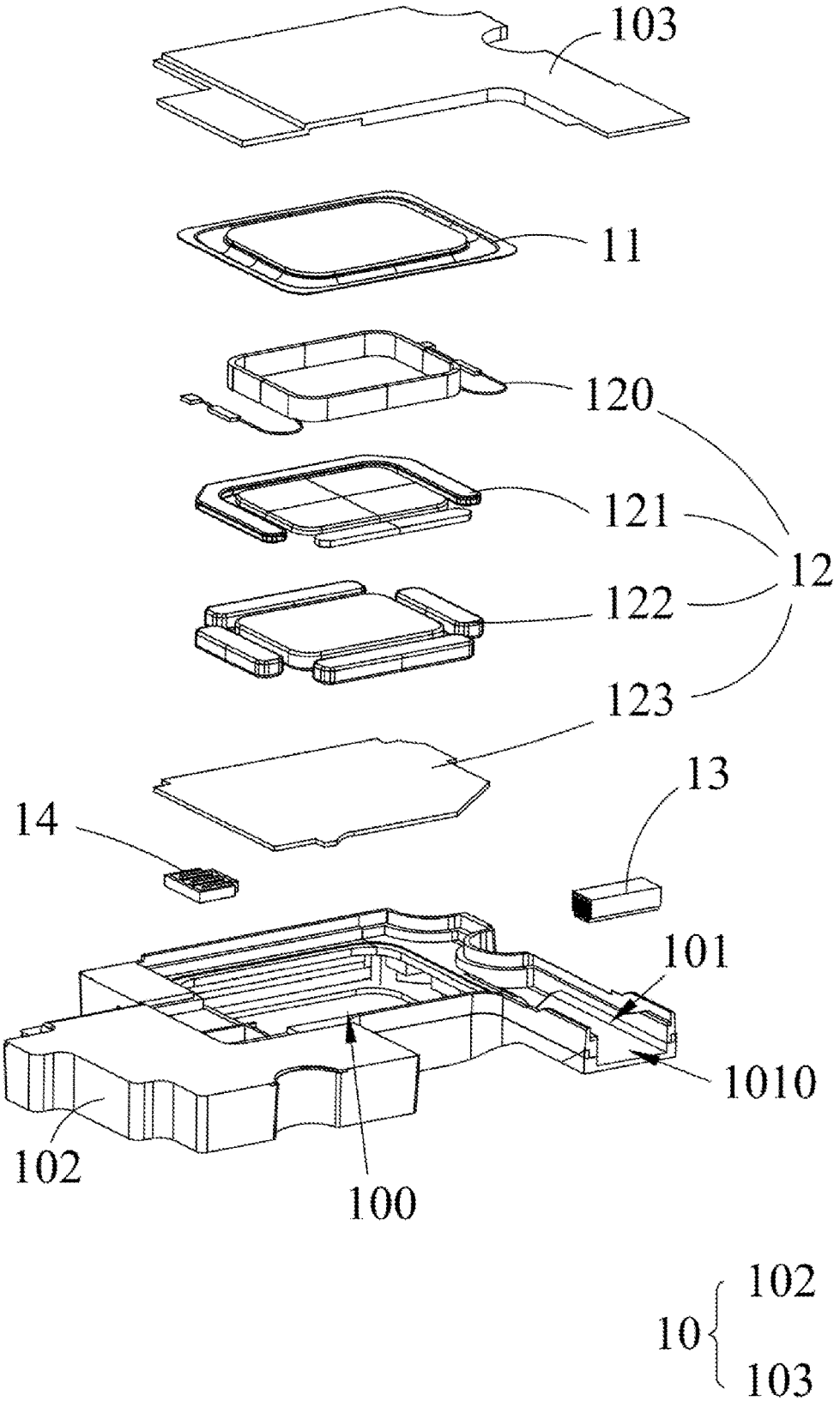
FIG. 3 is another exploded view of a speaker according to an embodiment of the present disclosure.
Figure 4:
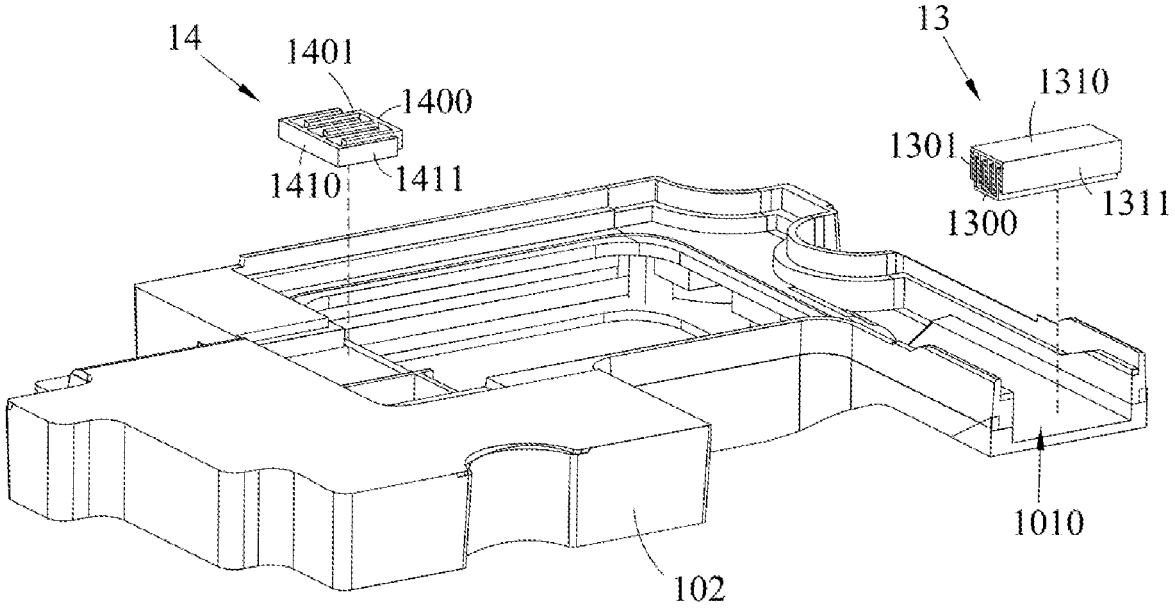
FIG. 4 is a schematic diagram of a case component, a first adjustment unit, and a second adjustment unit according to an embodiment of the present disclosure.

FIG. 1 to FIG. 3 are a schematic diagram, an exploded view, and another exploded view of a speaker according to an embodiment of the present disclosure, and FIG. 4 is a schematic diagram of a case component, a first adjustment unit, and a second adjustment unit according to an embodiment of the present disclosure. As shown in the figure, the speaker 1 includes a case component 10, a vibration plate 11, a driving component 12, a first adjustment unit 13, and a second adjustment unit 14. The case component 10 has an accommodating space 100 and a sound outlet channel 101, and the accommodating space 100 communicates with the sound outlet channel 101. The vibration plate 11 is disposed in the accommodating space 100. The driving component 12 is disposed in the accommodating space 100 and configured to drive the vibration plate 11 to vibrate. The first adjustment unit 13 is disposed in the sound outlet channel 101 and constituted of acoustic metamaterials. The second adjustment unit 14 is disposed on one side of the vibration plate 11 and is constituted of acoustic metamaterials.

Figure 6:
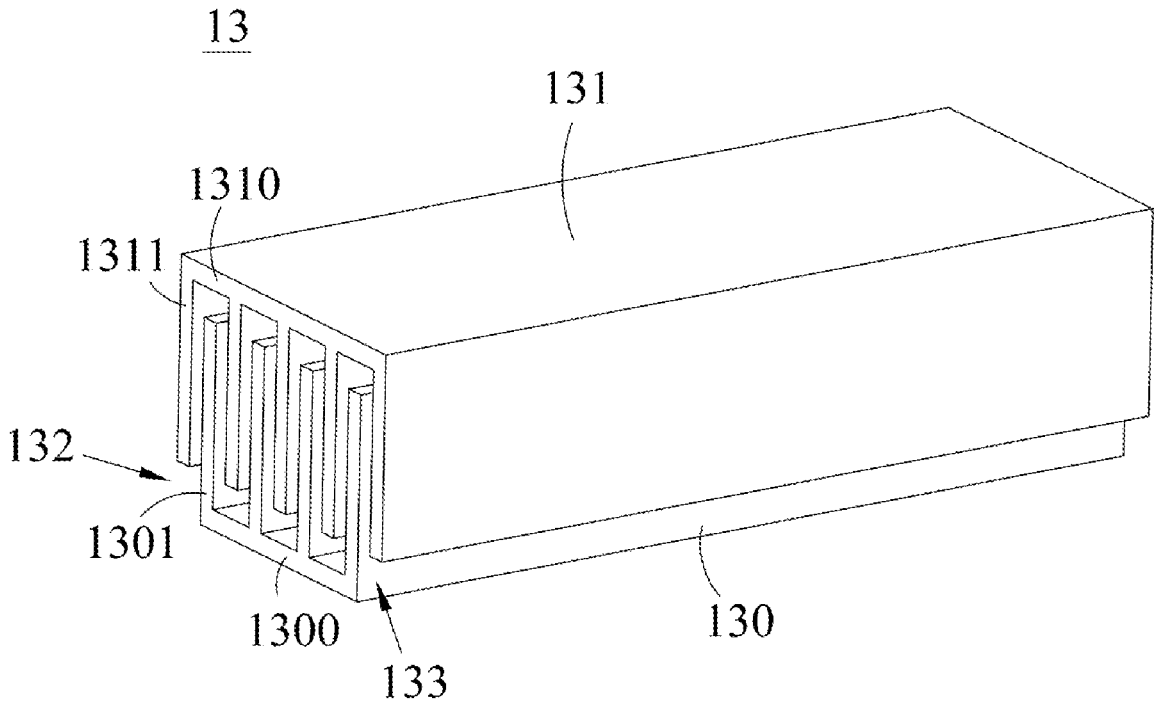
FIG. 6 is a perspective view of a first adjustment unit according to an embodiment of the present disclosure.
Figure 7:
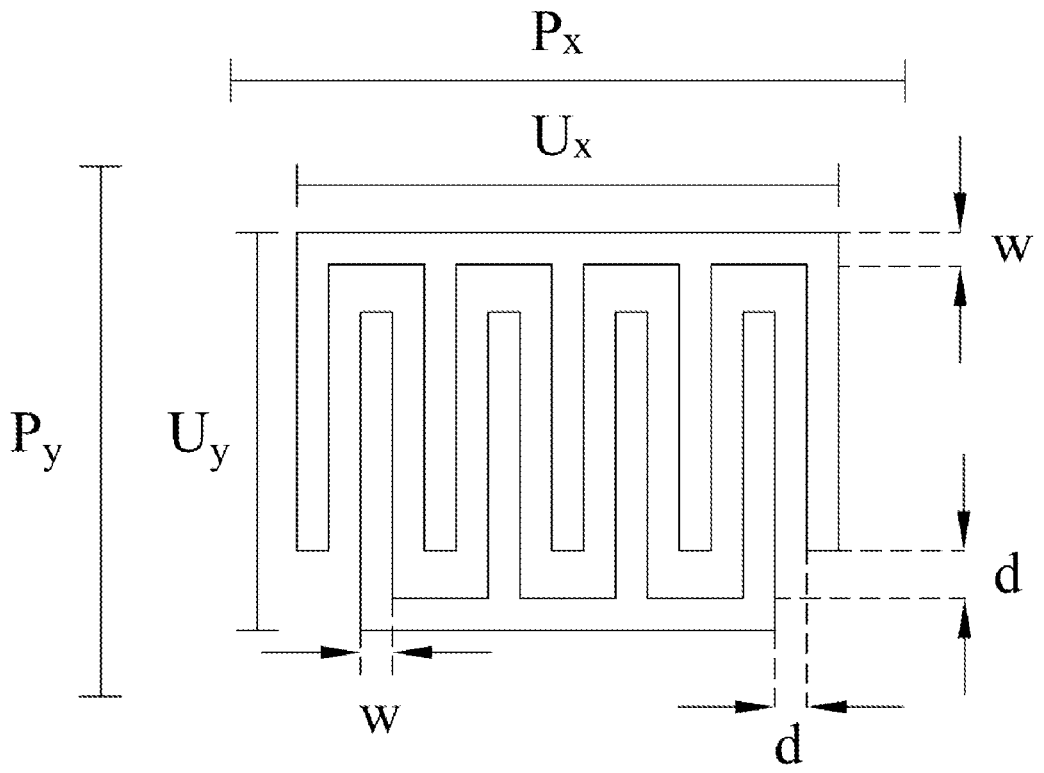
FIG. 7 is a top view of a first adjustment unit according to an embodiment of the present disclosure.

Acoustic metamaterials are artificially fabricated composite structures. With the structure size much smaller than the wavelength of sound waves, acoustic metamaterials have many special properties that natural materials do not have. That is, acoustic metamaterial changes acoustical physical properties thereof by adjusting the size, so as not to be limited by the physical properties of the material (eg, making the refractive index of a certain space greater than 1). Specifically, acoustic metamaterials are made of solid materials with a specific shape, and the rest of the space is filled with air. FIG. 6 and FIG. 7 respectively are a perspective view and a top view of the first adjustment unit according to an embodiment of the present disclosure. As shown in FIG. 7, the solid materials of the acoustic metamaterial have a thickness w, a unit length $U_x$, a unit width $U_y$, and an interval width d between the solid materials. Furthermore, the acoustic metamaterial also has a space length $P_x$ and a space width $P_y$ that may respond to the surroundings (for example, the space size where local resonance actually occurs), and the space length $P_x$ and space width $P_y$ are respectively greater than or equal to the unit length $U_x$ and the unit width $U_y$. Furthermore, the design of the acoustic metamaterial needs to conform to the following formula:

$$d=1.7w, U_x=9w+8d=22.6w$$

$$r=P_x/P_y$$

$$U_y=U_x/r$$

$$n_{eff}*k_0*1=\pi/2$$

$$k_0=2*\pi*\mathrm{freq}_0/c_0$$

Wherein, $n_{eff}$ is the refractive index (eg, the refractive index nair of air is 1), 1 is Px*Py, and c0 is the speed of sound in air (343 m/s). As a result, the dimensions of the acoustic metamaterial may be calculated according to the desired physical properties (eg, a specific refractive index) when designing an acoustic metamaterial.

Based on the principles mentioned above, the present disclosure achieves the effect of improving the response frequency curve by disposing a first adjustment unit 13 and a second adjustment unit 14. From the structure of the speaker 1, the accommodating space 100 of the case component 10 may be divided into a first accommodating space 100*a* (or may be referred to as a front cavity) and a second accommodating space (or may be referred to as a rear cavity) by the vibration plate 11. Wherein, the second adjustment unit 14 is in the first accommodating space 100*a*, and the driving component 12 is in the second accommodating space. In addition, the sound outlet channel 101 has a sound outlet 1010, and one end of the sound outlet channel 101 away from the sound outlet 1010 communicates with the first accommodating space 100*a*. The first adjustment unit 13 is on one end of the sound outlet channel 101 adjacent to the sound outlet 1010. That is, the present disclosure achieves an excellent frequency response curve by disposing the relative positions among the driving component 12, the vibration plate 11, the first adjustment unit 13, and the second adjustment unit 14 as described above.

In some embodiments, the first adjustment unit 13 is configured to adjust the frequency response curve of the speaker 1 in the frequency range of 6 to 10 kHz, and the second adjustment unit 14 is configured to adjust the frequency of the speaker 1 in the frequency range of 2 to 5 kHz. frequency response curve. "Adjustment" herein may be in two cases, one is to decrease the frequency response of the frequency range, and the other is to increase the frequency response of the frequency range. It should be noted that the frequency range mentioned above is only an example. The first adjustment unit 13 and the second adjustment unit 14 of the present disclosure may also be adjusted by changing the dimensions (for example, the thickness w, the unit length $U_x$ and the unit width $U_y$, mentioned above. etc.) to extend the frequency range.

Figure 5:
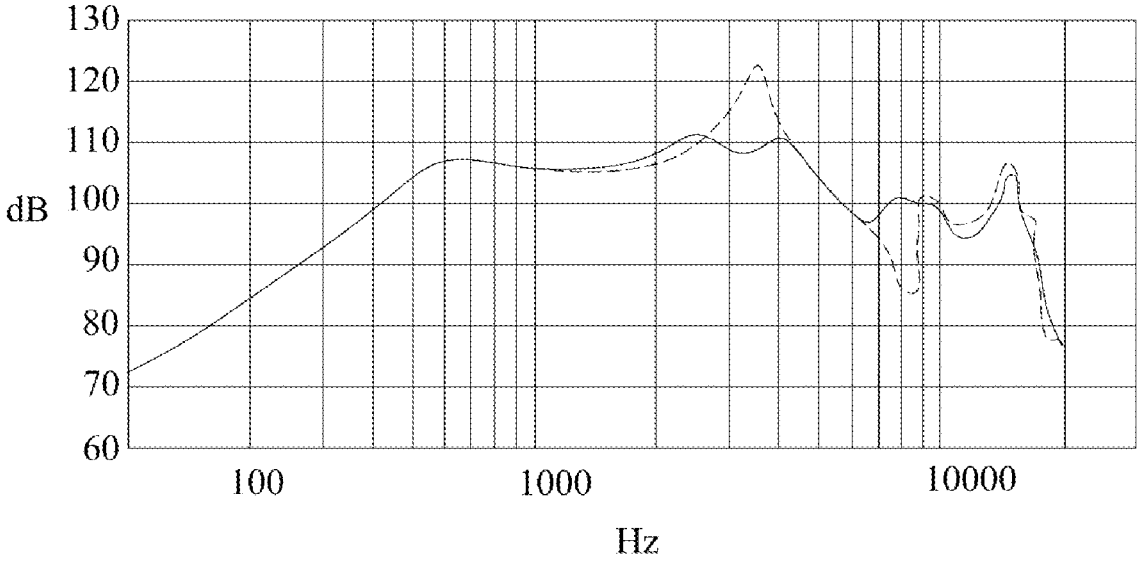
FIG. 5 is a test result of a frequency response curve of an embodiment of the present disclosure.

FIG. 5 is a test result of a frequency response curve according to an embodiment of the present disclosure. The solid line is the frequency response curve with the first adjustment unit 13 and the second adjustment unit 14, and the dotted line is the frequency response curve without the first adjustment unit 13 and the second adjustment unit 14. As shown in the figure, the speaker of the prior art has a sharp peak at the position in the frequency range of 2-5 kHz. In addition, the frequency response of the speaker of the prior art drops sharply at the position in the frequency range of 6-10 kHz. That is, there is a trough of the frequency response. On the other hand, after disposing the acoustic metamaterial with a specific size, the frequency response curve of the speaker is greatly optimized, thereby exhibiting a smooth curve. That is, the speaker of the present disclosure achieves excellent sound quality by disposing the adjustment unit. In order to make the present disclosure more understandable and clear, various implementation aspects of the present disclosure and the details of the components are described in detail hereinafter.

As shown in FIG. 2 and FIG. 4, in some embodiments, the first adjustment unit 13 may be directly formed in the sound outlet channel 101 by an injection molding process. However, the present disclosure is not limited thereto. In other embodiments, the first adjustment unit 13 may also be formed by die casting, forging, or 3D printing and then be disposed in the sound outlet channel 101 by an adhesive.

In some embodiments, the solid material of the first adjustment unit 13 may include a metal, such as aluminum. In some embodiments, the solid material of the first adjustment unit 13 may include plastic, such as polycarbonate. However, the present disclosure is not limited thereto. Any material recognized by a person having ordinary skill in the art may be used in the present disclosure.

As shown in FIG. 6 and FIG. 7, in some embodiments, the first adjustment unit 13 may include a first body 130 and a second body 131. The first body 130 has a first side plate 1300 and a plurality of first spacer plates 1301, and the plurality of first spacer plates 1301 are disposed on the first side plate 1300 at intervals. The second body 131 is oppositely disposed on one side of the first body 130, wherein the second body 131 has a second side plate 1310 and a plurality of second spacer plates 1311. The second side plate 1310 is disposed on one side of the plurality of first spacer plates 1301 away from the first side plate 1300, and the plurality of second spacer plates 1311 are disposed on the second side plate 1310 at intervals. The plurality of second spacer plates 1311 and the plurality of first spacer plates 1301 are alternately disposed and parallel to each other.

In some embodiments, each of the plurality of first spacer plates 1301 is between two adjacent ones of the plurality of second spacer plates 1311. That is, the two outermost spacer plates of the first adjustment unit 13 are the second spacer plates 1311. For example, the number of the plurality of first spacer plates 1301 is four, and the number of the plurality of second spacer plates 1311 is five. However, the present disclosure is not limited thereto. In other embodiments, the number of the plurality of first spacer plates 1301 may be two, three, five, or more than five, and the number of the plurality of second spacer plates 1311 may be three, four, six, or more than six. As long as the number of the plurality of second spacer plates 1311 is more than the number of the plurality of first spacer plates 1301 by one.

It should be noted that the present disclosure is not limited to the configuration mentioned above, the configuration may be determined according to the actual situation. For example, in other embodiments, the number of the plurality of first spacer plates 1301 may be the same as the number of the plurality of second spacer plates 1311. That is, the first adjustment unit 13 is composed of first body 130 and second body 131 symmetrical to each other, and the two outermost spacer plates of the first adjustment unit 13 respectively are the first spacer plate 1301 and the second spacer plate 1311.

As shown in FIG. 4, in some embodiments, the first side plate 1300 and the second side plate 1310 are placed horizontally on the sound outlet channel 101, and the two outermost second spacer plates 1311 face the opening direction of the sound outlet channel 101. That is, the acoustic metamaterial of the first adjustment unit 13 observed in FIG. 7 is toward the left and right side walls surrounding the sound outlet channel 101. It should be noted that the disposing method mentioned above is only an example, and the present disclosure is not limited thereto. In other embodiments, the acoustic metamaterial of the first adjustment unit 13 observed in FIG. 7 may also face the opening direction of the sound outlet channel 101.

In some embodiments, the first adjustment unit 13 includes a first adjustment inlet 132 and a first adjustment outlet 133. The first adjustment inlet 132 and the first adjustment outlet 133 respectively are between adjacent first spacer plates 1301 and second spacer plates 1311. The first adjustment inlet 132 is close to the first accommodating space 100*a*, and the first adjustment outlet 133 is close to the sound outlet 1010. That is, the sound emitted by the vibration plate 11 enters the first adjustment unit 13 through the first adjustment inlet 132 and exits the first adjustment unit 13 through the first adjustment outlet 133 after being interfered.

As shown in FIG. 2, in some embodiments, the second adjustment unit 14 may be directly formed on one side of the vibration plate 11 by an injection molding process. However, the present disclosure is not limited thereto. In other embodiments, the second adjustment unit 14 may also be formed by die casting, forging, or 3D printing and then be disposed on one side of the vibration plate 11 by an adhesive.

In some embodiments, the case component 10 may also have a side space 100*b*. The side space 100*b* communicates with the first accommodating space 100*a*. For example, there may be a plate with a channel between the side space 100*b* and the first accommodating space 100*a*, and the side space 100*b* communicates with the first accommodating space 100*a* via the channel. The first accommodating space 100*a* is between the side space 100*b* and the sound outlet channel 101. For example, the side space 100*b* is at a side of the first accommodating space 100*a*, and the sound outlet channel 101 is at an opposite side of the first accommodating space 100*a*. In this case, the second adjustment unit 14 may not be disposed in the first accommodating space 100*a* but in the side space 100*b*. That is, the case component 10 may be designed with a dedicated accommodating area corresponding to the second adjustment unit 14 to better accommodate the second adjustment unit 14. Compared with the disposing method mentioned above, the present embodiment provides an implementation aspect with the disposing position slightly offset but with the same effect. It should be noted that, in some cases, the side space 100*b* may also be regarded as a part of the first accommodating space 100*a* (because they communicate with each other). In such cases, the second adjustment unit 14 may be disposed in the side space 100*b* of the first accommodating space 100*a*. Therefore, the implementation aspects herein are only to explain the present disclosure from different aspects, not to limit the present disclosure.

In some embodiments, the solid material of the second adjustment unit 14 may include a metal, such as aluminum. In some embodiments, the solid material of the second adjustment unit 14 may include a plastic, such as polycarbonate. However, the present disclosure is not limited thereto. Any material recognized by a person having ordinary skill in the art may be used in the present disclosure.

Figure 8:
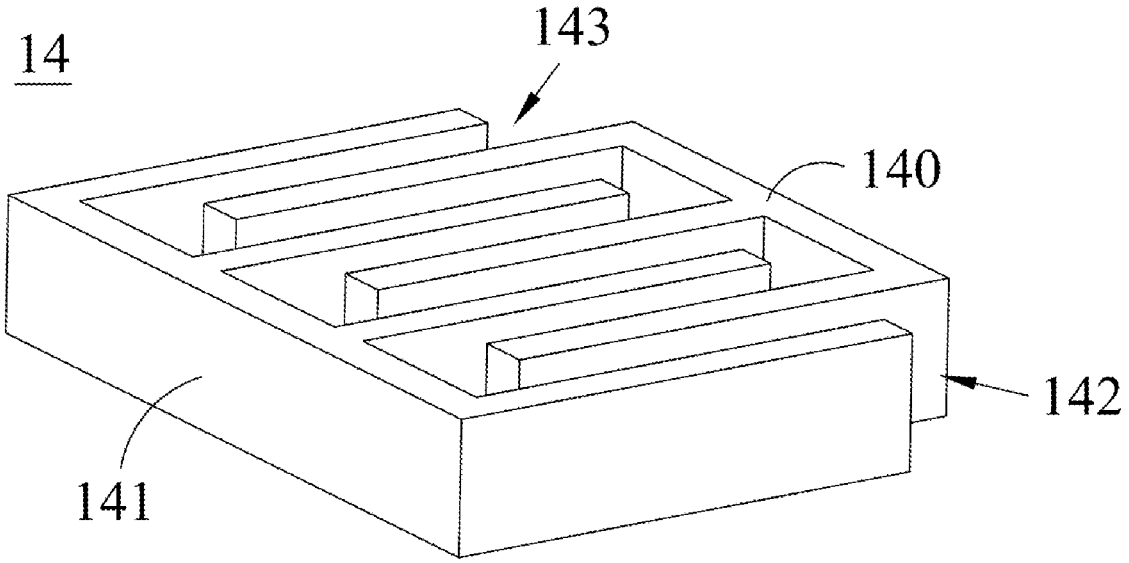
FIG. 8 is a perspective view of a second adjustment unit according to an embodiment of the present disclosure.
Figure 9:
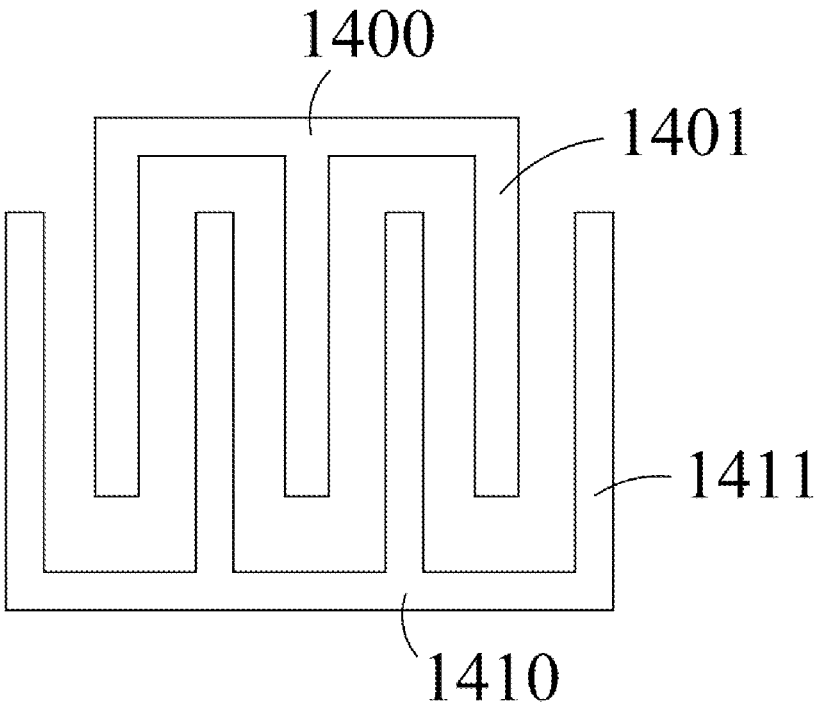
FIG. 9 is a side view of a second adjustment unit according to an embodiment of the present disclosure.

FIG. 8 and FIG. 9 respectively are a perspective view and a side view of the second adjustment unit according to an embodiment of the present disclosure. As shown in the figure, in some embodiments, the second adjustment unit 14 includes a third body 140 and a fourth body 141. The third body 140 has a third side plate 1400 and a plurality of third spacer plates 1401. The plurality of third spacer plates 1401 are disposed on the third side plate 1400 at intervals. The fourth body 141 is oppositely disposed to one side of the third body 140, wherein the fourth body 141 has a fourth side plate 1410 and a plurality of fourth spacer plates 1411. The fourth side plate 1410 is disposed on one side of the plurality of third spacer plates 1401 away from the third side plate 1400, and the plurality of fourth spacer plates 1411 are disposed on the fourth side plate 1410 at intervals. The plurality of third spacer plates 1401 and the plurality of fourth spacer plates 1411 are interleaved and parallel to each other.

In some embodiments, each of the plurality of third spacer plates 1401 is between two adjacent ones of the plurality of fourth spacer plates 1411. Similar to the configuration of the first adjustment unit 13, the two outermost spacer plates of the second adjustment unit 14 are fourth spacer plates 1411. In some embodiments, the number of the plurality of third spacer plates 1401 is three, and the number of the plurality of fourth spacer plates 1411 is four. However, the present disclosure is not limited thereto. In other embodiments, the number of the plurality of third spacer plates 1401 may be two, four, five, or more than five, and the number of the plurality of fourth spacer plates 1411 may be three, five, six, or more than six. As long as the number of the plurality of fourth spacer plates 1411 is more than the number of the plurality of third spacer plates 1401 by one. However, the present disclosure is not limited to the configuration mentioned above, and the configuration may be determined according to actual situations. For a detailed description, please refer to the first adjustment unit 13. The description is omitted herein.

As shown in FIG. 2 and FIG. 4, in some embodiments, the third side plate 1400 and the fourth side plate 1410 are vertically erected on one side of the vibration plate 11, and the third side plate 1400 and the fourth side plate 1410 face the accommodating space 100. In addition, the plurality of third spacer plates 1401 and the plurality of fourth spacer plates 1411 are vertically erected on one side of the vibration plate 11 and face the opening direction of the sound outlet channel 101. That is, the acoustic metamaterial of the second adjustment unit 14 observed in FIG. 8 faces the top cover 103 of the speaker 1 (as shown in FIG. 2).

In some embodiments, the second adjustment unit 14 includes a second adjustment outlet 142 and a third adjustment outlet 143. The second adjustment outlet 142 and the third adjustment outlet 143 respectively are between adjacent third spacer plates 1401 and fourth spacer plates 1411. The second adjustment outlet 142 and third adjustment outlet 143 both face the first accommodating space 100*a*. That is, the sound emitted by the vibration plate 11 may enter the second adjustment unit 14 through the second adjustment outlet 142, and exits the second adjustment unit 14 through the third adjustment outlet 143 after being interfered. Alternatively, the sound emitted by the vibration plate 11 may enter the second adjustment unit 14 through the third adjustment outlet 143, and exits the second adjustment unit 14 through the second adjustment outlet 142 after being interfered.

As shown in FIG. 3, in some embodiments, the driving component 12 may include a coil 120, an upper pole piece 121, a magnet 122, and a lower pole piece 123. The coil 120 is disposed on the vibration plate 11. The upper pole piece 121 is disposed on the coil 120. The magnet 122 is disposed on the upper pole piece 121. The lower pole piece 123 is disposed on the magnet 122. Wherein, the coil 120 is configured to receive current and form a magnetic field. The formed magnetic field interacts with the upper pole piece 121, the magnet 122, and the lower pole piece 123 so that the coil 120 drives the vibration plate 11 located thereon to vibrate.

In some embodiments, the case component 10 may include a case 102 and a top cover 103. The case 102 has an accommodating space 100 therein. The top cover 103 is disposed on the case 102 and covers the accommodating space 100 of the case 102 and the components located in the accommodating space 100.

In summary, the speaker of the present disclosure improves the frequency response curve by the first adjustment unit disposed on the sound outlet channel and the second adjustment unit disposed on one side of the vibration plate. More specifically, the first adjustment unit and the second adjustment unit are respectively constituted of acoustic metamaterialss, so the frequency response curve may be effectively improved without taking up too much space. In addition, the speaker's sound quality is not affected and the difficulty of speaker production does not increase by the acoustic metamaterials. As a result, the present disclosure achieves a speaker with an excellent frequency response curve.

Although the present disclosure has been explained in relation to its preferred embodiment, it does not intend to limit the present disclosure. It will be apparent to those skilled in the art having regard to this present disclosure that other modifications of the exemplary embodiments beyond those embodiments specifically described here may be made without departing from the spirit of the invention. Accordingly, such modifications are considered within the scope of the invention as limited solely by the appended claims.

What is claimed is:

1. A speaker, comprising:

a case component having an accommodating space and a sound outlet channel, wherein the accommodating space communicates with the sound outlet channel;

a vibration plate disposed in the accommodating space;

a driving component disposed in the accommodating space, wherein the driving component is configured to drive the vibration plate to vibrate;

a first adjustment unit disposed in the sound outlet channel, wherein the first adjustment unit is constituted of acoustic metamaterials, and a second adjustment unit disposed on one side of the vibration plate, wherein the second adjustment unit is constituted of acoustic metamaterials.

2. The speaker of claim 1, wherein the first adjustment unit is configured to adjust a frequency response curve of the speaker in a frequency range of 6-10 kHz, and the second adjustment unit is configured to adjust the frequency response curve of the speaker in a frequency range of 2~5 kHz.

3. The speaker of claim 1, wherein the accommodating space is divided into a first accommodating space and a second accommodating space by the vibrating plate, the second adjustment unit is in the first accommodating space, the driving component is in the second accommodating space, the sound outlet channel has a sound outlet, and one end of the sound outlet channel away from the sound outlet communicates with the first accommodating space.

4. The speaker of claim 3, wherein the first adjustment unit comprises:

a first body, wherein the first body has a first side plate and a plurality of first spacer plates, the plurality of first spacer plates are disposed on the first side plate at intervals; and a second body oppositely disposed on one side of the first body, wherein the second body has a second side plate and a plurality of second spacer plates, the second side plate is disposed on one side of the plurality of first spacer plates away from the first side plate, the plurality of second spacer plates are disposed on the second side plate at intervals, and the plurality of second spacer plates and the plurality of first spacer plates are alternately disposed and parallel to each other.

5. The speaker of claim 4, wherein the first adjustment unit comprises a first adjustment inlet and a first adjustment outlet, the first adjustment inlet and the first adjustment outlet are respectively between two adjacent ones of the plurality of first spacer plates and the plurality of second spacer plates, the first adjustment inlet is closer to the first accommodating space, and the first adjustment outlet is closer to the sound outlet.

6. The speaker of claim 4, wherein each of the plurality of first spacer plates is between two adjacent ones of the plurality of second spacer plates.

7. The speaker of claim 4, wherein the first adjustment unit is configured to adjust a frequency response curve of the speaker in a frequency range of 6-10 kHz, and the second adjustment unit is configured to adjust the frequency response curve of the speaker in a frequency range of 2~5 kHz.

8. The speaker of claim 4, wherein the case component further has a side space, the side space forms a part of the first accommodating space, the first accommodating space is between the side space and the sound outlet channel, and the second adjustment unit is in the side space.

9. The speaker of claim 1, wherein the accommodating space is divided into a first accommodating space and a second accommodating space by the vibration plate, the driving component is in the second accommodating space, the case component further has a side space, the side space communicates with the first accommodating space, the first accommodating space is between the side space and the sound outlet channel, and the second adjustment unit is in the side space.

10. The speaker of claim 9, wherein the side space is at a side of the first accommodating space, and the sound outlet channel is at an opposite side of the first accommodating space.

11. The speaker of claim 9, wherein the second adjustment unit comprises:

a third body, wherein the third body has a third side plate and a plurality of third spacer plates, the plurality of third spacer plates are disposed on the third side plate at intervals; and a fourth body oppositely disposed on one side of the fourth body, wherein the fourth body has a fourth side plate and a plurality of fourth spacer plates, the fourth side plate is disposed on one side of the plurality of third spacer plates away from the third side plate, the plurality of fourth spacer plates are disposed on the fourth side plate at intervals, and the plurality of third spacer plates and the plurality of fourth spacer plates are alternately disposed and parallel to each other.

12. The speaker of claim 11, wherein the second adjustment unit comprises a second adjustment outlet and a third adjustment outlet, the second adjustment outlet and the third adjustment outlet are respectively between two adjacent ones of the plurality of fourth spacer plates and the plurality of third spacer plates, and the second adjustment outlet and the third adjustment outlet both face the first accommodating space.

13. The speaker of claim 11, wherein each of the plurality of third spacer plates is between two adjacent ones of the plurality of fourth spacer plates.

* * * * *